US010753639B2

(12) United States Patent
Komatsu et al.

(10) Patent No.: US 10,753,639 B2
(45) Date of Patent: Aug. 25, 2020

(54) INDOOR UNIT AND AIR-CONDITIONING APPARATUS

(71) Applicant: Mitsubishi Electric Corporation, Tokyo (JP)

(72) Inventors: Takahiro Komatsu, Tokyo (JP); Takaaki Takishita, Tokyo (JP); Tatsuo Furuta, Tokyo (JP); Naoya Matsunaga, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 106 days.

(21) Appl. No.: 15/758,758

(22) PCT Filed: Oct. 8, 2015

(86) PCT No.: PCT/JP2015/078661
§ 371 (c)(1),
(2) Date: Mar. 9, 2018

(87) PCT Pub. No.: WO2017/061013
PCT Pub. Date: Apr. 13, 2017

(65) Prior Publication Data
US 2019/0041087 A1 Feb. 7, 2019

(51) Int. Cl.
*F24F 13/20* (2006.01)
*F24F 1/0007* (2019.01)
(Continued)

(52) U.S. Cl.
CPC ..... *F24F 13/20* (2013.01); *F24F 1/0007* (2013.01); *F24F 1/26* (2013.01); *F24F 1/32* (2013.01); *F24F 1/34* (2013.01); *F24F 13/30* (2013.01)

(58) Field of Classification Search
CPC .. F24F 13/20; F24F 1/0007; F24F 1/26; F24F 1/32; F24F 1/34; F24F 13/30
See application file for complete search history.

(56) References Cited

U.S. PATENT DOCUMENTS 7,596,962 B2 * 10/2009 Karamanos ..... F24F 1/26 62/259.1
2012/0000230 A1 1/2012 Matsuura et al.
(Continued)

FOREIGN PATENT DOCUMENTS

JP 2007-298205 A 11/2007
JP 2009-210153 A 9/2009
(Continued)

OTHER PUBLICATIONS

Extended European Search Report dated May 10, 2019 issued in corresponding EP patent application No. 15905832.0.
(Continued)

*Primary Examiner* — Filip Zec
(74) *Attorney, Agent, or Firm* — Posz Law Group, PLC

(57) ABSTRACT

An indoor unit includes a main body unit including a housing having an opening hole for pipe formed on a part of a side surface of the main body unit, a refrigerant pipe connection part projecting from inside to outside of the housing through the opening hole for pipe, and an attachment plate holding and fixing the refrigerant pipe connection part together with the housing to close the opening hole for pipe. The opening hole for pipe is formed over a first side surface on a side of the housing from which the refrigerant pipe connection part projects and a second side surface adjacent to the first side surface, and the attachment plate has an L shape including planes corresponding to the opening hole for pipe over the first side surface and the second side surface.

7 Claims, 11 Drawing Sheets

(51) Int. Cl.

| | |
|---|---|
| ***F24F 1/32*** | (2011.01) |
| ***F24F 1/34*** | (2011.01) |
| ***F24F 1/26*** | (2011.01) |
| ***F24F 13/30*** | (2006.01) |

(56) References Cited

U.S. PATENT DOCUMENTS

| | | | | |
|---|---|---|---|---|
| 2016/0076790 | A1* | 3/2016 | Kojima | F24F 13/20<br>454/237 |
| 2016/0290676 | A1* | 10/2016 | Ogura | F24F 1/32 |
| 2017/0370597 | A1* | 12/2017 | Kaneda | F28F 9/26 |
| 2018/0356123 | A1* | 12/2018 | Watanabe | F24F 1/02 |

FOREIGN PATENT DOCUMENTS

| | | | |
|---|---|---|---|
| JP | 2012-013271 | A | 1/2012 |
| JP | 2013-029281 | A | 2/2013 |

OTHER PUBLICATIONS

International Search Report dated Dec. 28, 2015 issued in corresponding international patent application No. PCT/JP2015/078661.

* cited by examiner

INDOOR UNIT AND AIR-CONDITIONING APPARATUS

CROSS REFERENCE TO RELATED APPLICATION

This application is a U.S. national stage application of PCT/JP2015/078661 filed on Oct. 8, 2015, the contents of which are incorporated herein by reference.

TECHNICAL FIELD

The present invention relates to an indoor unit or others. In particular, the present invention relates to an indoor unit or others in which a refrigerant pipe connection part projects from a main body to the outside.

BACKGROUND ART

There has been known air-conditioning devices including refrigerant circuits to perform air-conditioning by using evaporation, condensation and other action of refrigerant. Among such air-conditioning devices, many ones are configured as a separate type, which includes, for example, an outdoor unit and an indoor unit and has a refrigerant circuit connecting the outdoor unit and the indoor unit by refrigerant pipes.

Here, the indoor unit includes a refrigerant pipe connection part projecting from a main body of the indoor unit to the outside. By causing the refrigerant pipe connection part to project to the outside, work to connect appliances in the indoor unit to outside refrigerant pipes can be done with ease. To cause the refrigerant pipe connection part to project to the outside, the refrigerant pipe connection part is brought to the outside through an opening hole for pipe formed on a part of a surface of a housing from the inside where the refrigerant pipe connection part is connected to the appliances. Then, an attachment plate is mounted onto the housing, and a part of the hole except for the refrigerant pipe connection part is covered with the attachment plate to close and seal the hole. By closing the hole with the attachment plate, leakage of air passing through the indoor unit from the parts other than an air outlet to the outside is prevented (for example, refer to Patent Literature 1).

CITATION LIST

Patent Literature

Patent Literature 1: Japanese Unexamined Patent Application Publication No. 2007-298205

SUMMARY OF INVENTION

Technical Problem

Here, to prevent condensation due to a temperature difference between the inside and outside of the indoor unit, a heat insulating material, such as an insulator, is mounted onto the refrigerant pipe connection part, a side of the attachment plate facing the inside of the indoor unit or others. In view of removing a gap between the housing and the attachment plate to prevent air leakage, the opening portion secured between the housing and the attachment plate to allow the refrigerant pipe connection part to project to the outside of the housing is equal to or less than the refrigerant pipe connection part to which the heat insulating material is mounted in size.

For this reason, when the attachment plate is to be mounted, the attachment plate is pressed against the heat insulating material to compress the heat insulating material. Consequently, due to repulsion of the heat insulating material, it is difficult to align positions of screw holes of the attachment plate and the housing, and thus, mountability of the attachment plate is reduced. Moreover, as a repulsive direction of the heat insulating material is different from a direction of screw-fixing, the closed opening hole for pipe is caused to have a small gap between the attachment plate and the housing.

The present invention has been made to solve the above-described problem and has as an object to obtain an indoor unit or others with a structure capable of doing mounting work with ease to close an opening hole for pipe without causing a gap as mentioned above.

Solution to Problem

An indoor unit according to one embodiment of the present invention includes a main body unit including a housing having an opening hole for pipe formed on a part of a side surface of the main body unit, a refrigerant pipe connection part projecting from inside to outside of the housing through the opening hole for pipe, and an attachment plate holding and fixing the refrigerant pipe connection part together with the housing and closing the opening hole for pipe. The opening hole for pipe is formed over a first side surface on a side of the housing from which the refrigerant pipe connection part projects and a second side surface adjacent to the first side surface, and the attachment plate has an L shape including planes corresponding to the opening hole for pipe over the first side surface and the second side surface.

Advantageous Effects of Invention

According to one embodiment of the present invention, by using a plate of an L shape as an attachment plate to close an opening hole for pipe formed to allow a refrigerant pipe connection part to project to the outside, it is possible to effectively suppress repulsion that may be caused in two directions by a heat insulating material attached to the refrigerant pipe connection part or others for insulating heat inside and outside of a main body unit. Consequently, misalignment due to the repulsion of the heat insulating material is not caused, and thereby mounting work or other related work can be done with ease. Moreover, as it is possible to seal a space between the housing and the attachment plate and a space between the heat insulating materials without causing a gap, a heat insulation effect can be increased.

DESCRIPTION OF EMBODIMENTS

Figure 1:
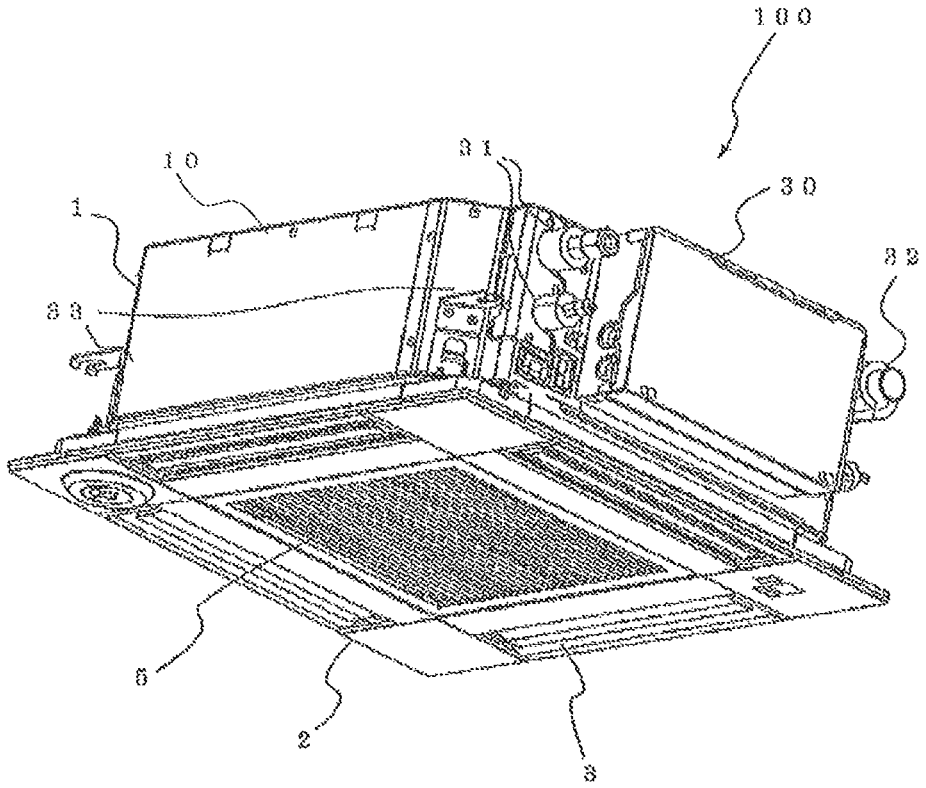
FIG. 1 is a diagram showing an appearance of an indoor unit 100 according to Embodiment 1 of the present invention.

Hereinafter, an indoor unit or others according to embodiments of the present invention will be described with reference to drawings. In the following drawings, components assigned with the same reference signs are the same or corresponding components, and the reference signs are common in all of the sentences in the embodiments to be described. Also, forms of constituents represented in all of the sentences in the specification are only examples, and the present invention is not limited to the forms described in the specification. In particular, a combination of constituents is not limited to the combination in each embodiment, constituents described in one embodiment can be applied to another embodiment. Moreover, a description will be given by assuming that an upper portion in the figure is "upper side" and a lower portion is "lower side". Also, in the drawings, relations between sizes of components in the following figures are different from those in actuality in some cases.

Embodiment 1

FIG. 1 is a diagram showing an appearance of an indoor unit 100 according to Embodiment 1 of the present invention. In the embodiment, as a typical example of an indoor unit, the indoor unit 100 that is a type that can be embedded in a ceiling in a room and a four-way cassette type having air outlets 3 in four directions will be described. The indoor unit 100 is connected to an outdoor unit 200 to be described later by pipes to form a refrigerant circuit circulating refrigerant to perform refrigeration, air conditioning or other functions. Here, the indoor unit 100 will be described as one in an air-conditioning apparatus.

A main body unit 1 constituting the indoor unit 100 is a unit including main appliances implementing functions of the indoor unit 100. In a housing 10 serving as a main-body outer shell included in the main body unit 1, for example, an indoor heat exchanger 110 or other appliances shown in FIG. 13 to be described later are incorporated. The housing 10 of the main body unit 1 in the embodiment includes a top surface facing a space above the ceiling and side surfaces serving as wall surfaces along the air outlets 3, and a bottom surface side is opened. On the side surfaces, four corners are chamfered, and thereby inclined surfaces or others are formed between the side surfaces. Moreover, on a lower side of the main body unit 1, a decorative panel 2 facing an indoor space side and serving as an external panel of the indoor unit 100 is mounted. At a center portion of the decorative panel 2, a suction grill 5 constituting an air inlet sucking indoor air into the main body unit 1 is placed. Moreover, in each of the portions corresponding to outer sides of the suction grill 5, a corresponding one of the air outlets 3 each including a wind direction control vane is provided. In addition, in the indoor unit 100 of the embodiment, an electrical component case 30, refrigerant pipe connection parts (or refrigerant pipe connectors) 31, a drain pipe connection part 32, and installation bolt attachment brackets 33 are provided on the outer surfaces of the housing 10.

Figure 2:
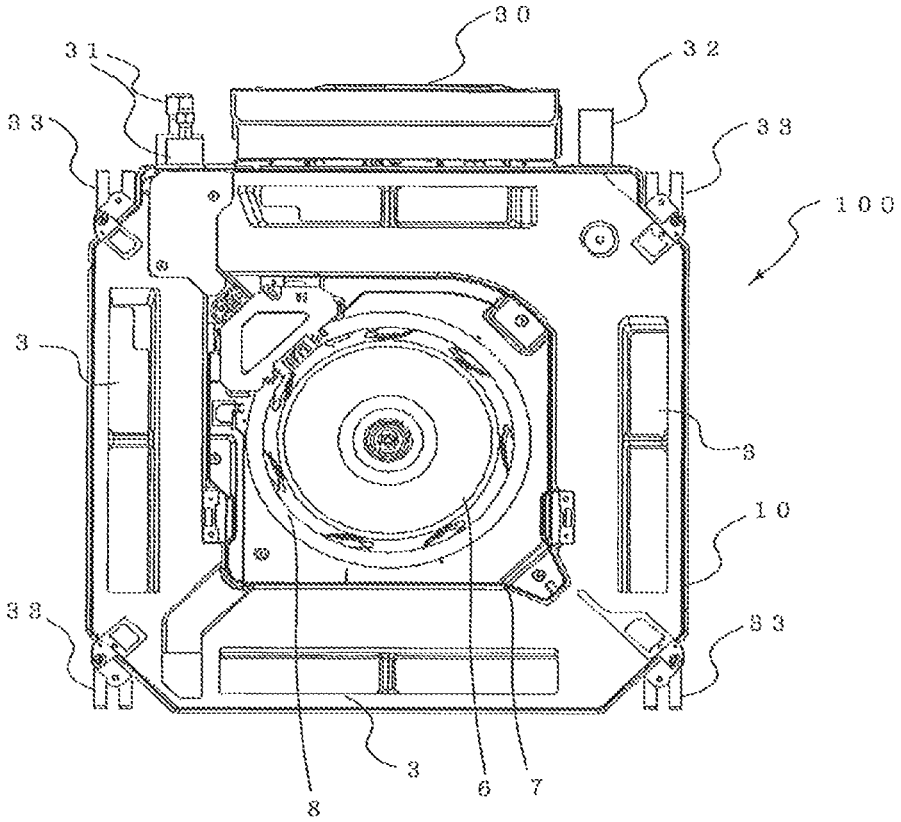
FIG. 2 is a diagram showing a main body unit 1 of the indoor unit 100 according to Embodiment 1 of the present invention, viewed from an indoor space side.

FIG. 2 is a diagram showing the main body unit 1 of the indoor unit 100 according to Embodiment 1 of the present invention, viewed from the indoor space side. As shown in FIG. 2, the indoor unit 100 includes a turbofan 6 at a center portion inside the main body unit 1. When the turbofan 6 is driven, a flow path of air passing through the main body unit 1 from the air inlet to the air outlets 3 is formed. Moreover, a drain pan 7 collects drain water generated from the indoor heat exchanger 110 provided to enclose the turbofan 6. A bell mouth 8 rectifies air flowing from the air inlet as the turbofan 6 is driven. Moreover, the indoor heat exchanger 110 acts, for example, as an evaporator evaporating refrigerant to cool indoor air during cooling operation. The indoor heat exchanger 110 acts as a condenser condensing refrigerant to heat the indoor air during heating operation.

As described above, in the indoor unit 100 of the embodiment, the electrical component case 30 or others are included on the outer surface side of the housing 10, and the electrical component case 30, the refrigerant pipe connection parts 31 and the drain pipe connection part 32 are placed, not on the inclined surface formed by chamfering, but on the side surfaces of the housing 10 of the main body unit 1. Consequently, for example, the refrigerant pipe connection parts 31 and the drain pipe connection part 32 are placed to project in the direction perpendicular to the side surface of the housing 10. Consequently, it is unnecessary to apply cutting process to end portions of the heat insulating material attached to the refrigerant pipe connection parts 31 and the drain pipe connection part 32 to conform to the inclined surface, and thus, works, such as electrical work, wiring, piping, and maintenance, can be done with ease. Moreover, the heat insulating material can be attached without causing gaps. Here, as shown in FIG. 2, the area of the inclined surfaces on the side surfaces on which the electrical component case 30, the refrigerant pipe connection parts 31 and the drain pipe connection part 32 are placed are limited as needed to attach the installation bolt attachment brackets 33. For this reason, the area capable of placing the electrical component case 30 or others can further be increased.

The electrical component case 30 contains electrical appliances, such as a drive circuit driving the appliances included in the indoor unit 100, such as a fan, and a controller controlling to drive the appliances. Here, the controller is composed of, for example, a microprocessor unit or others. However, the controller is not limited to the microprocessor unit, and may be composed of, for example, those that can be updated, such as firmware, or a program module executed in accordance with instructions from a CPU or others.

The drain pipe connection part 32 serves as a connection portion between a drain pipe discharging the drain water collected in the drain pan 7, to be described later, to the outside of the indoor unit 100 and the drain pan 7 inside the main body unit 1. Moreover, the installation bolt attachment brackets 33 serving as hanging brackets are attached to the inclined surfaces formed on the four corners of the housing 10 by chamfering. The main body unit 1 is fixed by fastening the installation bolt attachment brackets 33 to four installation bolts (not shown) hung above the ceiling, to place the indoor unit 100 on the ceiling.

The refrigerant pipe connection parts 31 serve as connection portions between the indoor heat exchanger 110 inside the main body unit 1 and the refrigerant pipes. The refrigerant pipes include, as will be described later, a gas refrigerant pipe 300 through which gas refrigerant also including refrigerant in a two-phase gas-liquid state passes and a liquid refrigerant pipe 400 through which liquid refrigerant also including refrigerant in a two-phase gas-liquid state passes. To connect the two of the refrigerant pipes and the indoor unit 100, the main body unit 1 of the embodiment includes two of the refrigerant pipe connection parts 31. Here, for example, one of the refrigerant pipe connection parts 31 with a smaller diameter is connected to the liquid refrigerant pipe 400, and the other one of the refrigerant pipe connection parts 31 with a larger diameter is connected to the gas refrigerant pipe 300.

Figure 3:
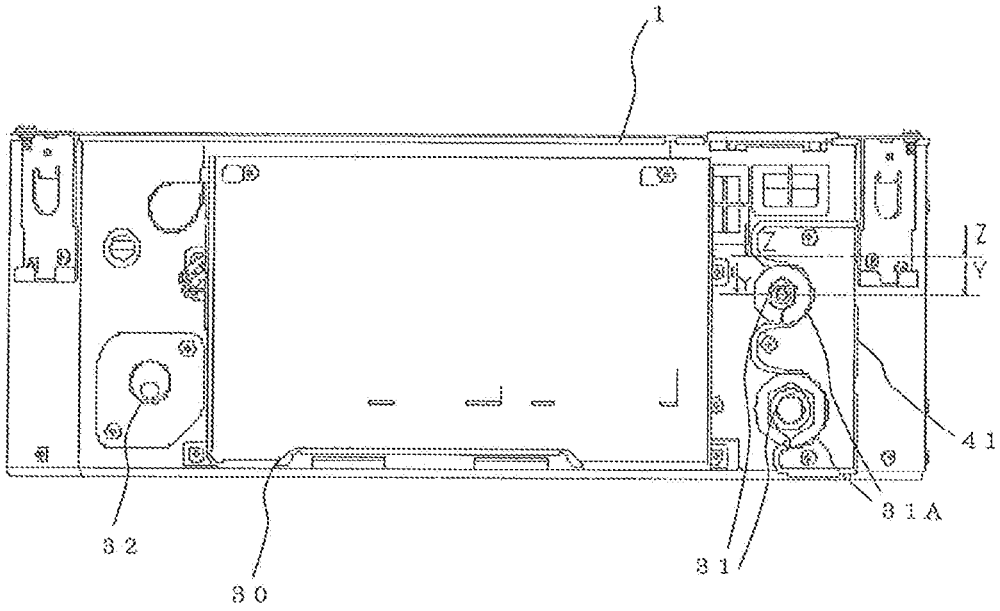
FIG. 3 is a diagram showing the main body unit 1 of the indoor unit 100 according to Embodiment 1 of the present invention, viewed from a surface side on which an electrical component case 30, refrigerant pipe connection parts 31 and a drain pipe connection part 32 are placed.

FIG. 3 is a diagram showing the main body unit 1 of the indoor unit 100 according to Embodiment 1 of the present invention, viewed from a surface side on which the electrical component case 30, the refrigerant pipe connection parts 31, and the drain pipe connection part 32 are placed. In the indoor unit 100 of the embodiment, as shown in FIG. 3, the two of the refrigerant pipe connection parts 31 are basically placed along the height direction. Further, the two of the refrigerant pipe connection parts 31 are disposed at positions different from each other in the width direction of the main body unit 1. Consequently, for example, when works to connect one of the refrigerant pipe connection parts 31 and the refrigerant pipe by using a wrench or other tools, or to attach the heat insulating material are to be done, the other one of the refrigerant pipe connection parts 31 does not become an encumbrance to the works, and a working space can be secured. Moreover, as a measure to address heat insulation and condensation, the two of the refrigerant pipe connection parts 31 have pipe covers 31A composed of, for example, a heat insulating material having elasticity, such as an insulator.

Figure 4:
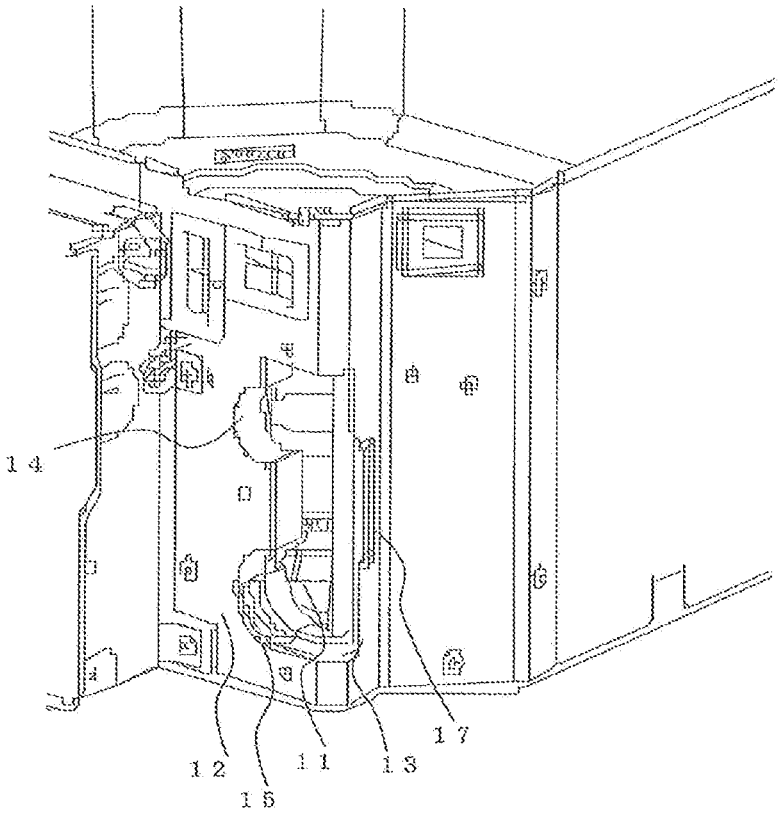
FIG. 4 is a diagram illustrating an opening hole for pipe 11 of the indoor unit 100 according to Embodiment 1 of the present invention.

FIG. 4 shows that, in the indoor unit 100 of the embodiment, an opening hole for pipe 11 for causing the refrigerant pipe connection parts 31 to pass from inside and project to the outside is formed on the side surfaces of the housing 10. In the embodiment, the opening hole for pipe 11 is formed at a corner portion extending over a first side surface 12 and a second side surface 13, which are two side surfaces of the housing 10. The opening hole for pipe 11 includes a U-shaped groove 14 and a U-shaped groove 15 that are suitable along the shapes of the refrigerant pipe connection parts 31. Here, if the opening hole for pipe 11 is formed by cutting out upper and lower ends of the housing 10, strength of the housing 10 is reduced. For this reason, the opening hole for pipe 11 is formed by drilling a hole in the housing 10. Also, as shown in FIG. 3, the attachment plate 41 and the first side surface 12 of the housing 10 hold the refrigerant pipe connection parts 31 and partially overlap each other to close the opening hole for pipe 11 from two directions.

Figure 5:
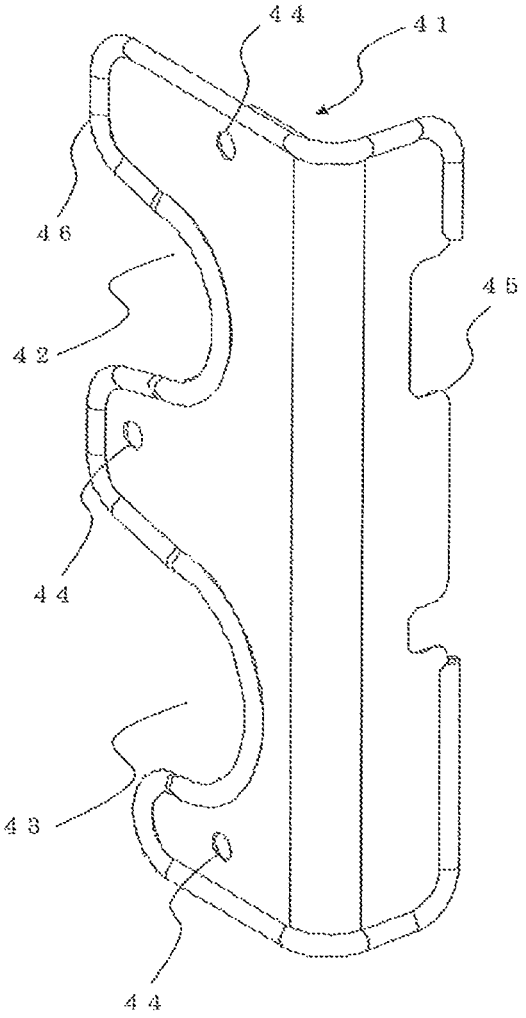
FIG. 5 is a diagram showing an attachment plate 41 of the indoor unit 100 according to Embodiment 1 of the present invention.

FIG. 5 is a diagram showing the attachment plate 41 of the indoor unit 100 according to Embodiment 1 of the present invention. FIG. 5 is a diagram showing the attachment plate 41 viewed from a side corresponding to an outer surface of the main body unit 1. In the indoor unit 100 of the embodiment, as the opening hole for pipe 11 is provided to extend over two planes at a corner portion of the housing 10, the attachment plate 41 has an L-shape to cover the both planes. On one plane side of the attachment plate 41, a U-shaped groove 42, and a U-shaped groove 43, each in a recessed shape, for holding the two of the refrigerant pipe connection parts 31 are formed. Moreover, the attachment plate 41 includes screw holes 44 for screw-fixing the attachment plate 41. Due to including the screw holes 44 on the plane corresponding to the first side surface 12 and screw-fixing, the attachment plate 41 is prevented from lifting up in a direction perpendicular to the first side surface 12 by repulsion of the pipe cover 31A, and gaps can be prevented. On the other hand, on the other plane side of the attachment plate 41, a latching claw 45 is provided. For example, in the work to mount the attachment plate 41, the latching claw 45 is inserted into a slit 17 formed on the housing 10, and thereby temporal fixing can be performed. Consequently, it is possible to prevent the attachment plate 41 from being misaligned in the width direction of the main body unit 1 by the repulsion of the pipe cover 31A, and the attachment plate 41 can be mounted with ease.

Also, the attachment plate 41 of the embodiment includes a curling 46 formed by curling an edge of the attachment plate 41 on at least an edge portion of the plane side corresponding to the first side surface 12. Consequently, the attachment plate 41 has no burr, and in the work of mounting, the attachment plate 41 can be moved smoothly without being caught on a surface of the pipe covers 31A, and thereby the attachment plate 41 can be prevented from lifting up. Moreover, the work of mounting can be done safely. Also, as a curved surface portion of the curling 46 and an outer circumferential surface of the pipe covers 31A can contact each other by surfaces, it is possible to increase adhesiveness. Consequently, the gaps are not caused among the refrigerant pipe connection parts 31, the housing 10, and the attachment plate 41, and no air leaks from inside to outside of the indoor unit 100, and thereby, for example, it is possible to prevent formation of condensation due to cold air leakage.

Figure 6:
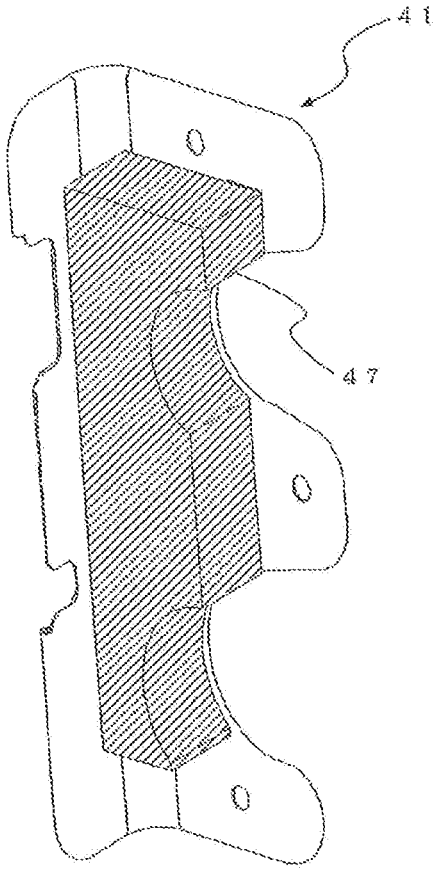
FIG. 6 is a diagram showing the attachment plate 41 of the indoor unit 100 according to Embodiment 1 of the present invention.

FIG. 6 is a diagram showing the attachment plate 41 of the indoor unit 100 according to Embodiment 1 of the present invention. FIG. 6 is a diagram showing the attachment plate 41 viewed from a side corresponding to an inner surface of the main body unit 1. As shown in FIG. 6, inside the attachment plate 41, a plate-side heat insulating material 47, such as an insulator, is provided to insulate the refrigerant pipe connection parts 31 and the attachment plate 41.

Figure 7:
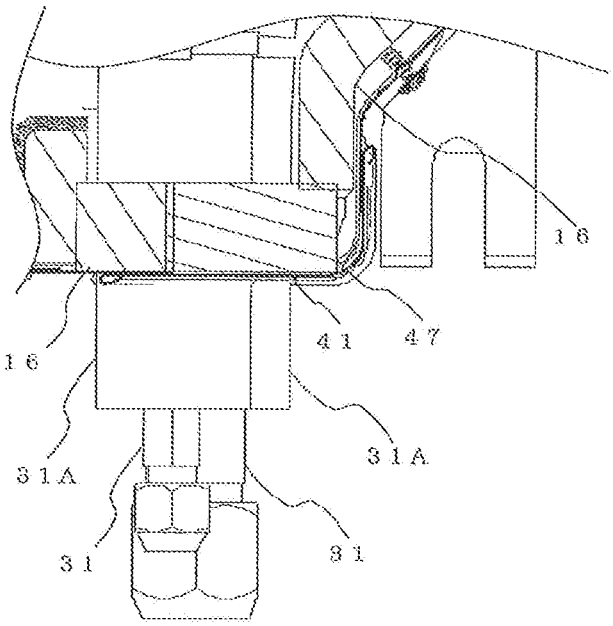
FIG. 7 is a first diagram illustrating heat insulation inside the main body unit 1 according to Embodiment 1 of the present invention.
Figure 8:
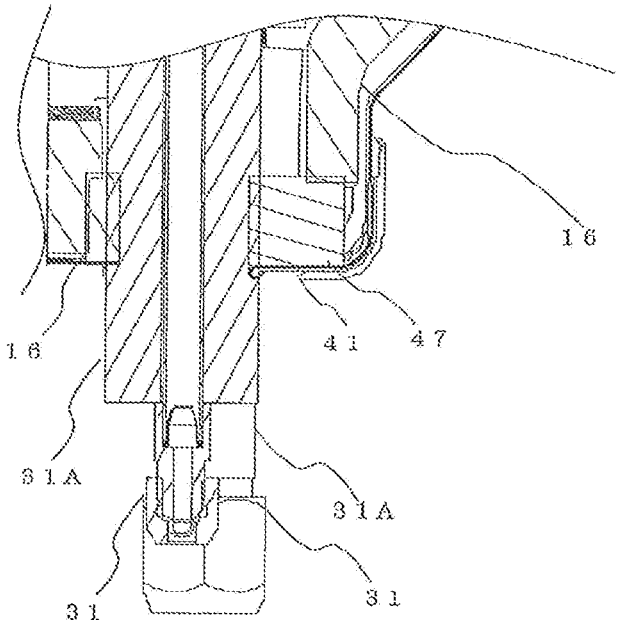
FIG. 8 is a second diagram illustrating heat insulation inside the main body unit 1 according to Embodiment 1 of the present invention.
Figure 9:
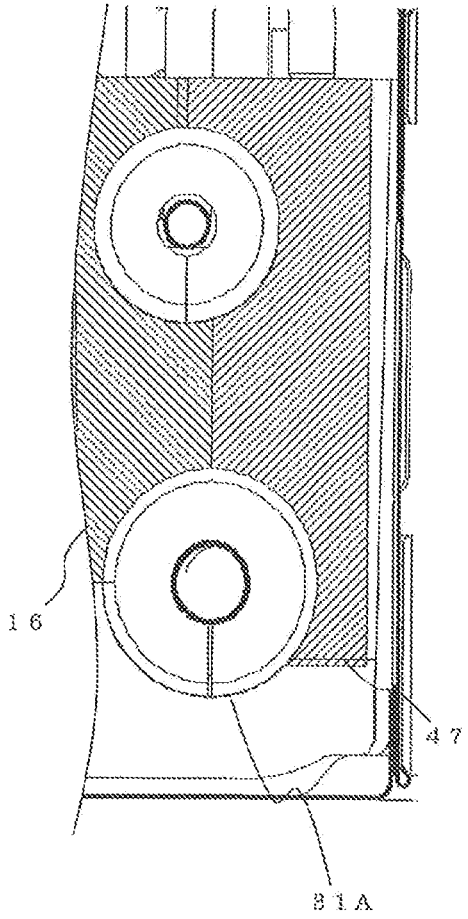
FIG. 9 is a third diagram illustrating heat insulation inside the main body unit 1 according to Embodiment 1 of the present invention.

FIGS. 7, 8, and 9 are diagrams illustrating heat insulation inside the main body unit 1 according to Embodiment 1 of the present invention. FIG. 7 is a diagram showing a cross section taken along line Z-Z shown in FIG. 3. Moreover, FIG. 8 is a diagram showing a cross section taken along line Y-Y shown in FIG. 3. FIG. 9 is a diagram showing a relationship among a main-body-side heat insulating material 16, the plate-side heat insulating material 47, and the refrigerant pipe connection parts 31, viewed from the inner surface side. As shown in FIGS. 7 to 9, on the inner surface side of the housing 10, the main-body-side heat insulating material 16 is attached in advance. When the attachment plate 41 is mounted, on the inner surface side of the housing 10, the main-body-side heat insulating material 16 and the plate-side heat insulating material 47 hold the refrigerant pipe connection parts 31.

Here, for example, if a material of the plate-side heat insulating material 47 is the same as or softer than a material of the main-body-side heat insulating material 16, the plate-side heat insulating material 47 is caught by the pipe cover 31A when the plate-side heat insulating material 47 is being mounted, and the plate-side heat insulating material 47 is deformed in some cases. Moreover, pressing to cause the plate-side heat insulating material 47 to adhere to the main-body-side heat insulating material 16 is weakened. For this reason, a gap may be caused between the main-body-side heat insulating material 16 and the plate-side heat insulating material 47. Consequently, in the embodiment, a case is assumed where the material of the plate-side heat insulating material 47 is harder than that of the main-body-side heat insulating material 16.

Figure 10:
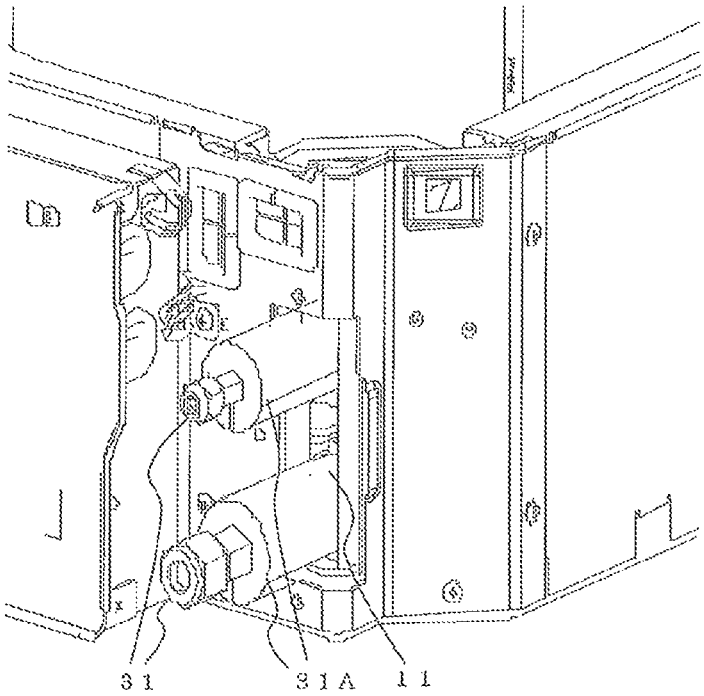
FIG. 10 is a first diagram illustrating mounting of the attachment plate 41 in the indoor unit 100 according to Embodiment 1 of the present invention.
Figure 11:
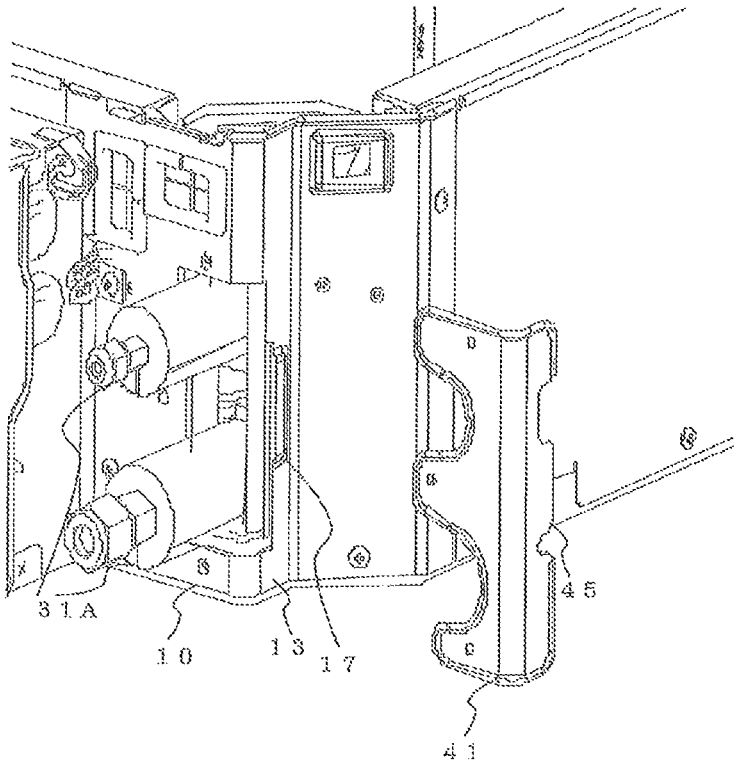
FIG. 11 is a second diagram illustrating mounting of the attachment plate 41 in the indoor unit 100 according to Embodiment 1 of the present invention.
Figure 12:
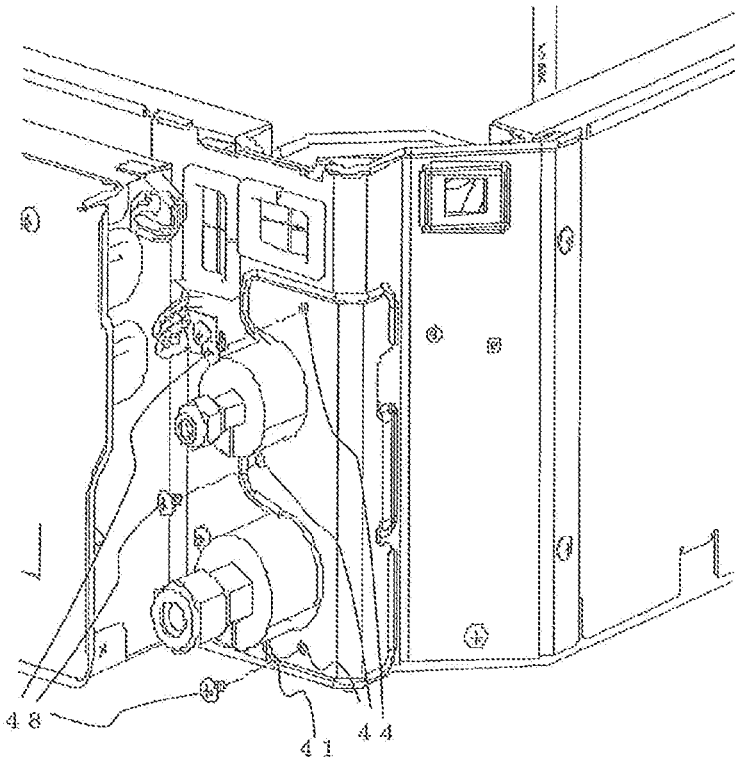
FIG. 12 is a third diagram illustrating mounting of the attachment plate 41 in the indoor unit 100 according to Embodiment 1 of the present invention.

FIGS. 10, 11, and 12 are diagrams illustrating mounting of the attachment plate 41 in the indoor unit 100 according to Embodiment 1 of the present invention. As shown in FIG. 10, the refrigerant pipe connection parts 31 having the pipe covers 31A are projected to the outside through the opening hole for pipe 11. At this time, the refrigerant pipe connection parts 31 are aligned to the positions of the U-shaped groove 14 and the U-shaped groove 15 of the housing 10, which are shown in the above-described FIG. 4.

Moreover, as shown in FIG. 11, the attachment plate 41 is mounted to the housing 10. Here, in the embodiment, the attachment plate 41 can be inserted from the direction of the second side surface 13. As a moving distance in a state in which the attachment plate 41 is in contact with the pipe covers 31A can be reduced by inserting the attachment plate 41 from the direction of the second side surface 13, it is possible to reduce catching between the attachment plate 41 and the pipe covers 31A and works can be done with ease. Then, the latching claw 45 is inserted into the slit 17 to temporarily fix the attachment plate 41. Subsequently, as shown in FIG. 12, in the temporarily fixed state, screws 48 are set to the screw holes 44 to mount the attachment plate 41.

As described above, in the indoor unit 100 of the embodiment, as the opening hole for pipe 11 opened to project the refrigerant pipe connection parts 31 to the outside is partially closed by the L-shaped attachment plate 41 mounted onto the housing 10 from two directions, it is possible to effectively suppress repulsion that can occur in two directions due to heat insulating material, such as the pipe covers 31A. Consequently, misalignment of the attachment plate 41 due to the repulsion of the pipe covers 31A or others is not caused, and thereby mounting work or other related work can be done with ease. Moreover, as it is possible to seal a space between the housing 10 and the attachment plate 41 and a space between the heat insulating materials without causing a gap, a heat insulation effect can be increased.

Moreover, as the attachment plate 41 includes the latching claw 45 and the latching claw 45 is inserted into the slit 17 of the housing 10, the attachment plate 41 can be temporarily fixed with ease. Further, as the attachment plate 41 includes the plate-side heat insulating material 47 holding the refrigerant pipe connection parts 31 together with the main-body-side heat insulating material 16 of the housing 10, heat insulation inside and outside of the main body unit can be performed by the attachment plate 41. At this time, as the material of the plate-side heat insulating material 47 is harder than that of the main-body-side heat insulating material 16, deformation of the plate-side heat insulating material 47 caused by catching or others can be prevented, and when the attachment plate 41 is mounted, it is possible not to cause any gaps between the pipe covers 31A and the main-body-side heat insulating material 16. Also, as the curling 46 formed by curling the edge of the attachment plate 41 is provided, the attachment plate 41 can be moved without being caught by the surface of the pipe covers 31A when the mounting work is being done. Moreover, no burr allows works to be done safely. Moreover, by increasing the area of the attachment plate 41 that is in contact with the pipe covers 31A, it is possible to prevent air leakage or others without causing gaps and to increase the heat insulation effect.

Moreover, as disposed positions of the refrigerant pipe connection parts 31 are different from each other, in doing connection work or others, working on one of the refrigerant pipe connection parts 31 is not disturbed by the other one of the refrigerant pipe connection parts 31.

Embodiment 2

Figure 13:
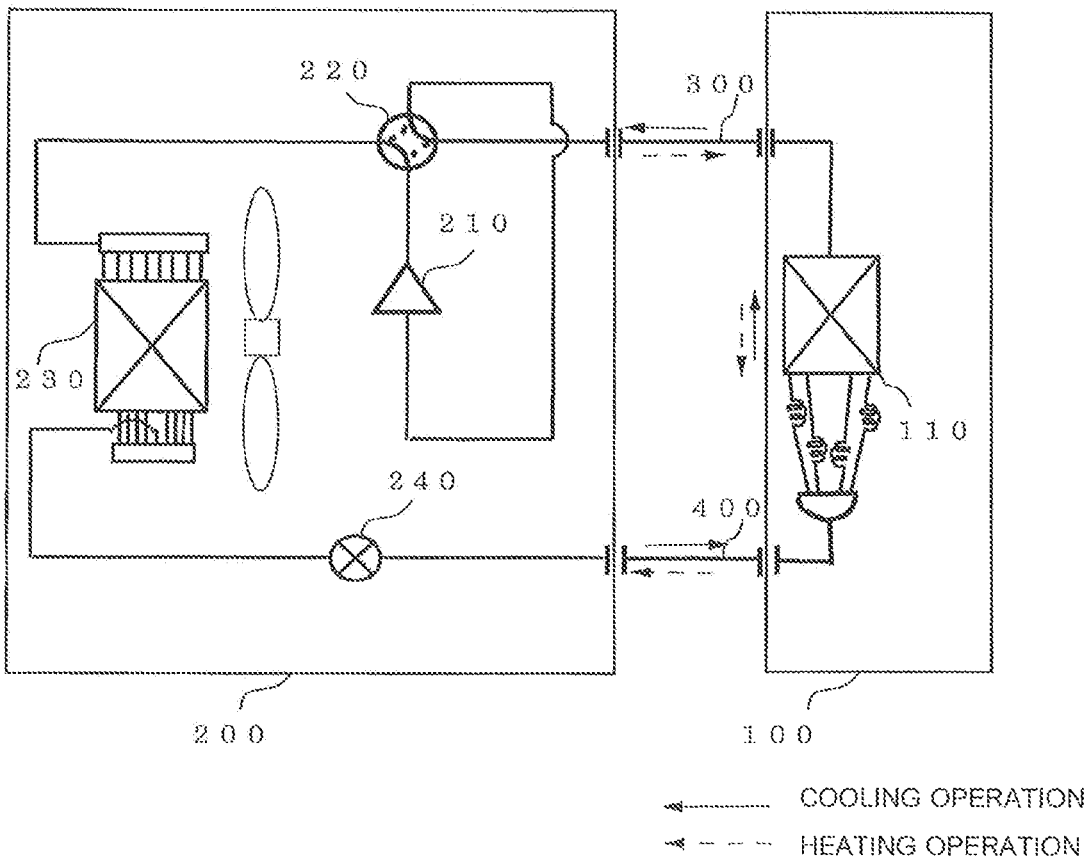
FIG. 13 is a diagram showing a configuration example of an air-conditioning apparatus according to Embodiment 2 of the present invention.

FIG. 13 is a diagram showing a configuration example of an air-conditioning apparatus according to Embodiment 2 of the present invention. Here, in FIG. 13, the air-conditioning apparatus is shown as an example of a refrigeration cycle device. A case is assumed where, in FIG. 13, similar operations are performed for those described in FIG. 1 or other figures. The air-conditioning apparatus in FIG. 8 connects an outdoor unit 200 and the indoor unit 100 described in Embodiment 1 by pipes via the gas refrigerant pipe 300 and the liquid refrigerant pipe 400. The outdoor unit 200 includes a compressor 210, a four-way valve 220, an outdoor heat exchanger 230 and an expansion valve 240.

The compressor 210 compresses sucked refrigerant and discharges the refrigerant. Here, the present invention is not particularly limited to the configuration in which the compressor 210 may be, for example, the one that varies a capacity (an amount of refrigerant sent per unit time) of the compressor 210 by arbitrarily varying an operating frequency by an inverter circuit or others. The four-way valve 220 switches, for example, a flow of refrigerant between the cooling operation and the heating operation.

The outdoor heat exchanger 230 in the embodiment exchanges heat between refrigerant and air (outdoor air). For example, the outdoor heat exchanger 230 acts as an evaporator in the heating operation, and evaporates and gasifies the refrigerant. Moreover, in the cooling operation, the outdoor heat exchanger 230 acts as a condenser, and condenses and liquefies the refrigerant.

The expansion valve 240, such as an expansion device and a flow rate control unit, reduces pressure of the refrigerant and expands the refrigerant. For example, when the expansion valve 240 is composed of an electronic expansion valve or other devices, an opening degree is adjusted in accordance with instructions of a controller (not shown) or others. The indoor heat exchanger 110 exchanges heat between, for example, air to be air-conditioned and refrigerant. In the heating operation, the indoor heat exchanger 110 acts as a condenser, and condenses and liquefies the refrigerant. Moreover, the indoor heat exchanger 110 acts as an evaporator in the cooling operation, and evaporates and gasifies the refrigerant.

With the air-conditioning apparatus configured as described above, the four-way valve 220 of the outdoor unit 200 switches the flow of refrigerant to makes it possible to achieve the heating operation and the cooling operation.

INDUSTRIAL APPLICABILITY

In one of the above-described embodiments, description is given on the assumption that the indoor unit 100 is of a four-way cassette type blowing out air in four directions from four air outlets 3; however, the present invention is not limited to such an example. For example, the present invention can be applied to other indoor units of ceiling-embedded types corresponding to air flow in two directions or three directions. Moreover, the present invention can be applied to indoor units of other types, not being limited to the indoor units of the ceiling-embedded types.

Moreover, in the other one of the above-described embodiments, description is given to the air-conditioning apparatus as an example of a refrigeration cycle device; however, the present invention is not limited to such an example. For example, the present invention can be applied to other one of the refrigeration cycle devices, such as a refrigerating device and a freezing device. Moreover, the present invention can be applied not only to the refrigeration cycle device, but also to an air-sending device, a ventilation device or other devices.

The invention claimed is:

1. An indoor unit comprising:

a main body unit including a housing having an opening hole for pipe formed on a part of a side surface of the main body unit;

at least one refrigerant pipe connector projecting from inside to outside of the housing through the opening hole for pipe; and an attachment plate holding and fixing the at least one refrigerant pipe connector together with the housing and closing the opening hole for pipe, the opening hole for pipe being formed over a first side surface on a side of the housing from which the at least one refrigerant pipe connector projects and a second side surface adjacent to the first side surface, the attachment plate having an L shape including planes corresponding to the opening hole for pipe over the first side surface and the second side surface, the attachment plate including a plate-side heat insulating material holding the at least one refrigerant pipe connector together with a main-body-side heat insulating material provided to an inner surface side of the housing, and the plate-side heat insulating material being harder than the main-body-side heat insulating material in an amount that prevents deformation of the plate-side heat insulating material when in contact with the main-body-side heat insulating material.

2. The indoor unit of claim 1, wherein the attachment plate includes a latching claw on one of the planes corresponding to the opening hole for pipe on the second side surface.

3. The indoor unit of claim 2, wherein the housing includes a slit on the second side surface, and the attachment plate is temporarily fixed with the latching claw inserted into the slit.

4. The indoor unit of claim 1, wherein the attachment plate includes an edge of at least one of the planes that is curled, the at least one of the planes corresponding to the opening hole for pipe on the first side surface.

5. The indoor unit of claim 1, wherein the attachment plate includes a screw hole on one of the planes corresponding to the opening hole for pipe on the first side surface.

6. The indoor unit of claim 1, wherein the at least one refrigerant pipe connector includes two of refrigerant pipe connectors projecting to the outside, and the two of refrigerant pipe connectors are disposed at positions different from each other in a height direction and a width direction of the main body unit.

7. An air-conditioning apparatus comprising the indoor unit of claim 1 and an outdoor unit to perform air conditioning.

* * * * *